US005743832A

United States Patent [19]

Sands et al.

[11] Patent Number: 5,743,832

[45] Date of Patent: Apr. 28, 1998

[54] FITNESS EQUIPMENT

[76] Inventors: Leonard Sands, 4555 Reseda Blvd., Tarzana, Calif. 91356; Johnson Kuo, 5F., No. 6, Lane 12, Sec. 6, Hsin I Rd., Taipei, Taiwan

[21] Appl. No.: 812,926

[22] Filed: Mar. 10, 1997

[51] Int. Cl.[6] ..... A63B 22/04; A63B 23/035

[52] U.S. Cl. ..... 482/52; 482/56; 482/112; 482/120; 482/130; 482/142

[58] Field of Search ..... 482/52, 56, 72, 482/73, 112, 113, 120, 128–130, 133, 142; 434/254

[56] References Cited

U.S. PATENT DOCUMENTS 5,505,679 4/1996 McBride et al. ..... 482/52 X 5,547,444 8/1996 Huang ..... 482/72

*Primary Examiner*—Richard J. Apley

*Assistant Examiner*—John Mulcahy

*Attorney, Agent, or Firm*—Varndell Legal Group

[57] ABSTRACT

A fitness equipment including a base, an oblique support equipped with bottom wheels and pivoted to the base to hold a bench with a seat cushion and a headrest for supporting the user, two handlebars coupled to the oblique support, two actuating rods respectively pivoted to the handlebars, a bracing collapsibly connected between the base and the oblique support, two collapsible pedals pivoted to the base and the oblique support, upper links and intermediate links and bottom links respectively pivotably connected between the oblique support and the actuating rods, a damping mechanism connected between the oblique support, upper and intermediate links, wherein when the user sits on the seat cushion with the back supported on the bench and the hands holding on the handlebars and the legs pedaling the pedals, the bottom links and the intermediate links and the upper links are alternatively driven to move the actuating rods and the connecting frames, enabling the user to simulate the action of swimming.

10 Claims, 10 Drawing Sheets

FITNESS EQUIPMENT

BACKGROUND AND SUMMARY OF THE INVENTION

The present invention relates to fitness equipment, and more specifically to a fitness equipment which enables the user to exercise the action of swimming.

A variety of fitness equipment have been disclosed exercising the body, and have appeared on the market. These fitness equipment are commonly heavy and not collapsible, therefore they need much storage space when not in use. Further, these conventional fitness equipment achieve limited exercising effect.

It is one object of the present invention to provide a fitness equipment which enables the user to exercise the action of swimming. It is another object of the present invention to provide a fitness equipment which enables the user to exercise the legs and the arms simultaneously. It is still another object of the present invention to provide a fitness equipment which is collapsible. It is still another object of the present invention to provide a fitness equipment which can be adjusted to subject to different exercising requirements. According to one aspect of the present invention, the fitness equipment comprises a base, an oblique support equipped with bottom wheels and pivoted to the base to hold a bench for supporting the user, two handlebars coupled to the oblique support, two actuating rods respectively pivoted to the handlebars, a bracing collapsibly connected between the base and the oblique support, two collapsible pedals pivoted to the base and the oblique support, upper links and intermediate links and bottom links respectively pivotably connected between the oblique support and the actuating rods, a damping mechanism connected between the oblique support, upper and intermediate links, wherein when the user sits on the seat cushion with the back supported on the bench and the hands holding on the handlebars and the legs pedaling the pedals, the bottom links and the intermediate links and the upper links are alternatively driven to move the actuating rods and the connecting frames, enabling the user to simulate the action of swimming. According to another aspect of the present invention, the bench comprises two bottom lugs with a respective serises of locating holes spaced at differnet angles, two top lugs with a respective series of locating holes spaced at different angles, two bottom arms respectively and adjustably fastened to the bottom lugs by a respective pin to hold a seat cushion, and two top arms respectively and adjustably fastened to the locating holes of the top lugs by a respective pin to hold a headrest.

DETAILED DESCRIPTION OF THE PREFERRED EMBODIMENT

Figure 1:
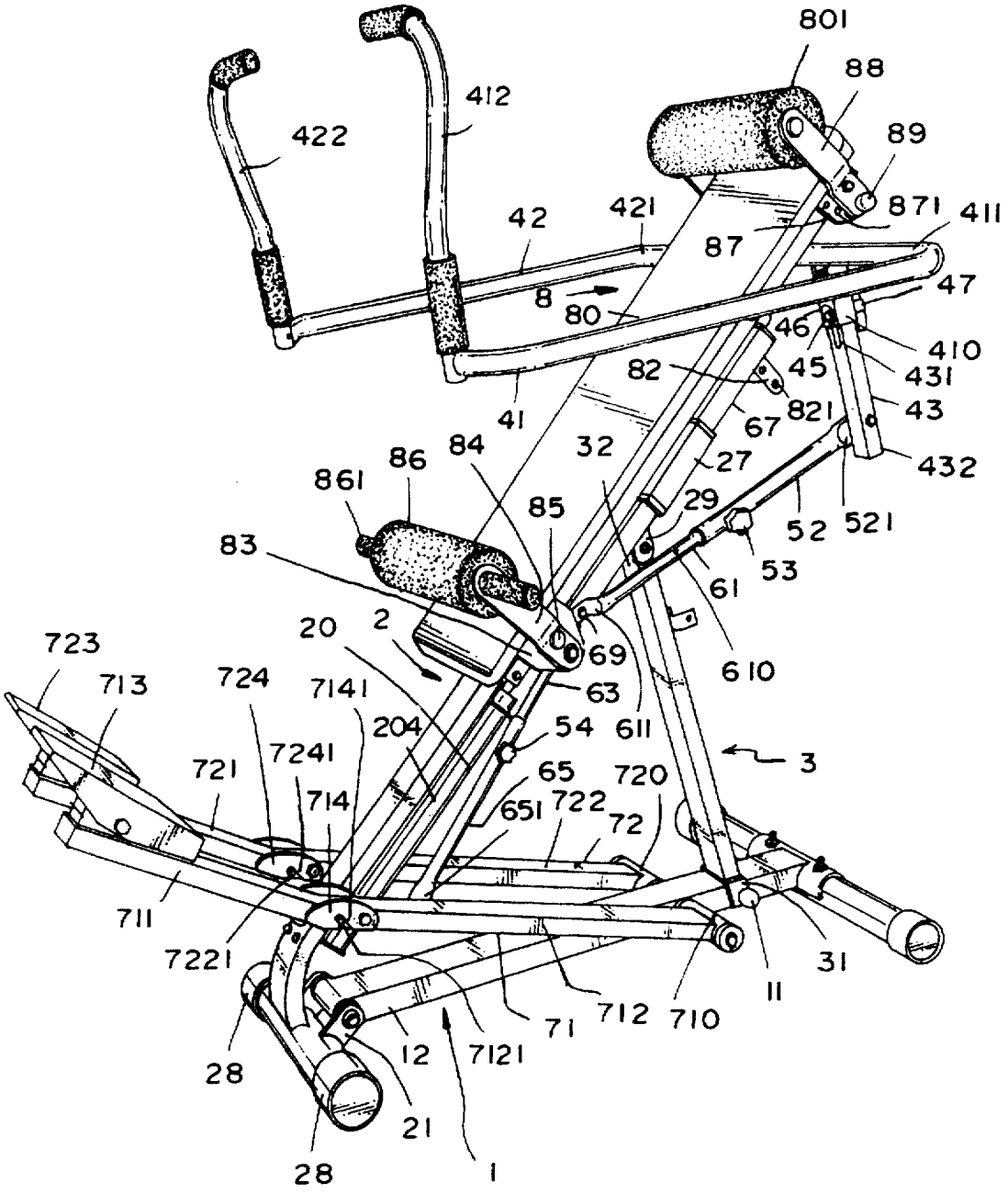
FIG. 1 is an elevational view of a fitness equipment according to the present invention.
Figure 2:
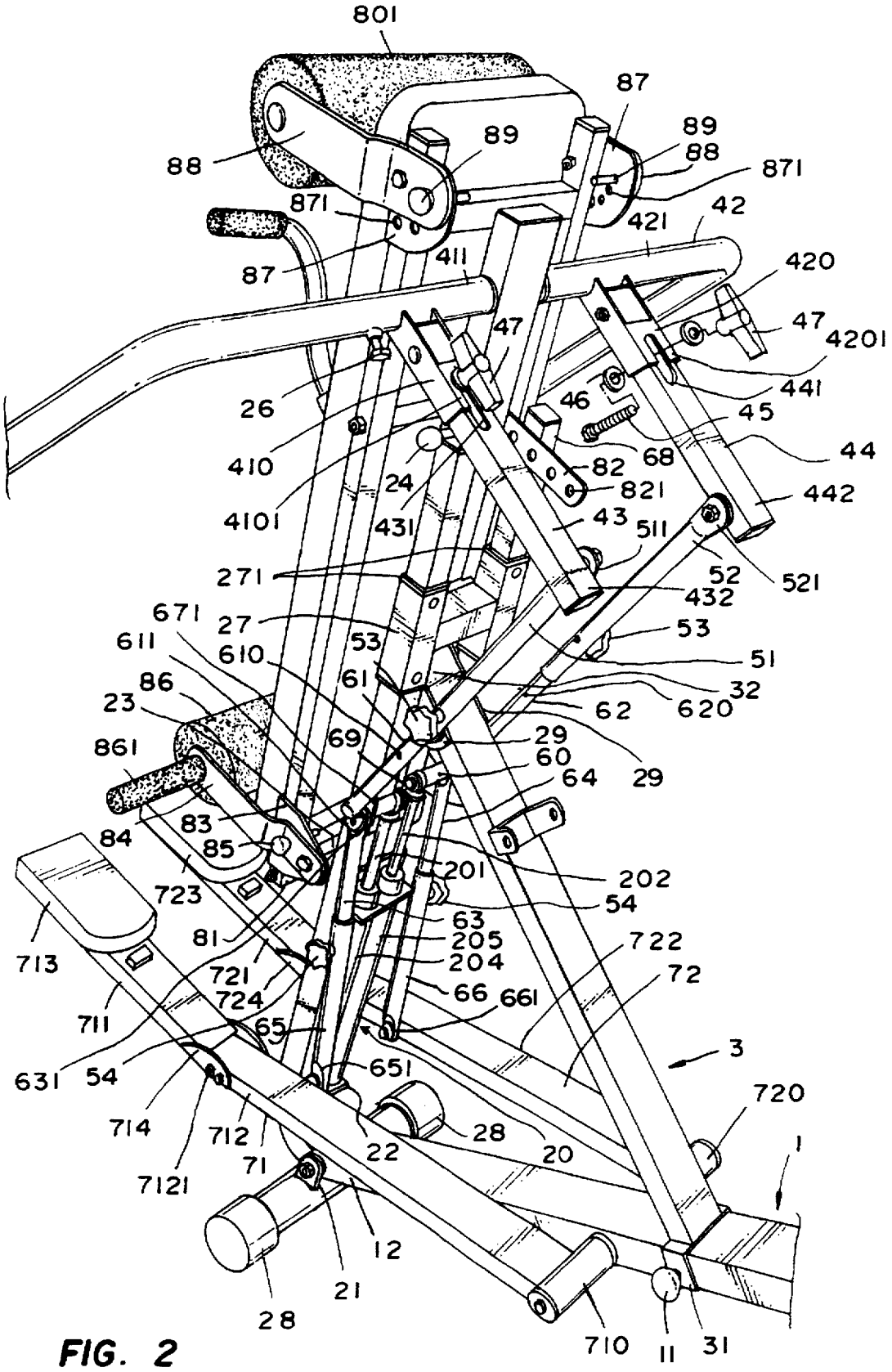
FIG. 2 is another elevational view of the fitness equipment of the present invention when viewed from another angle.
Figure 3:
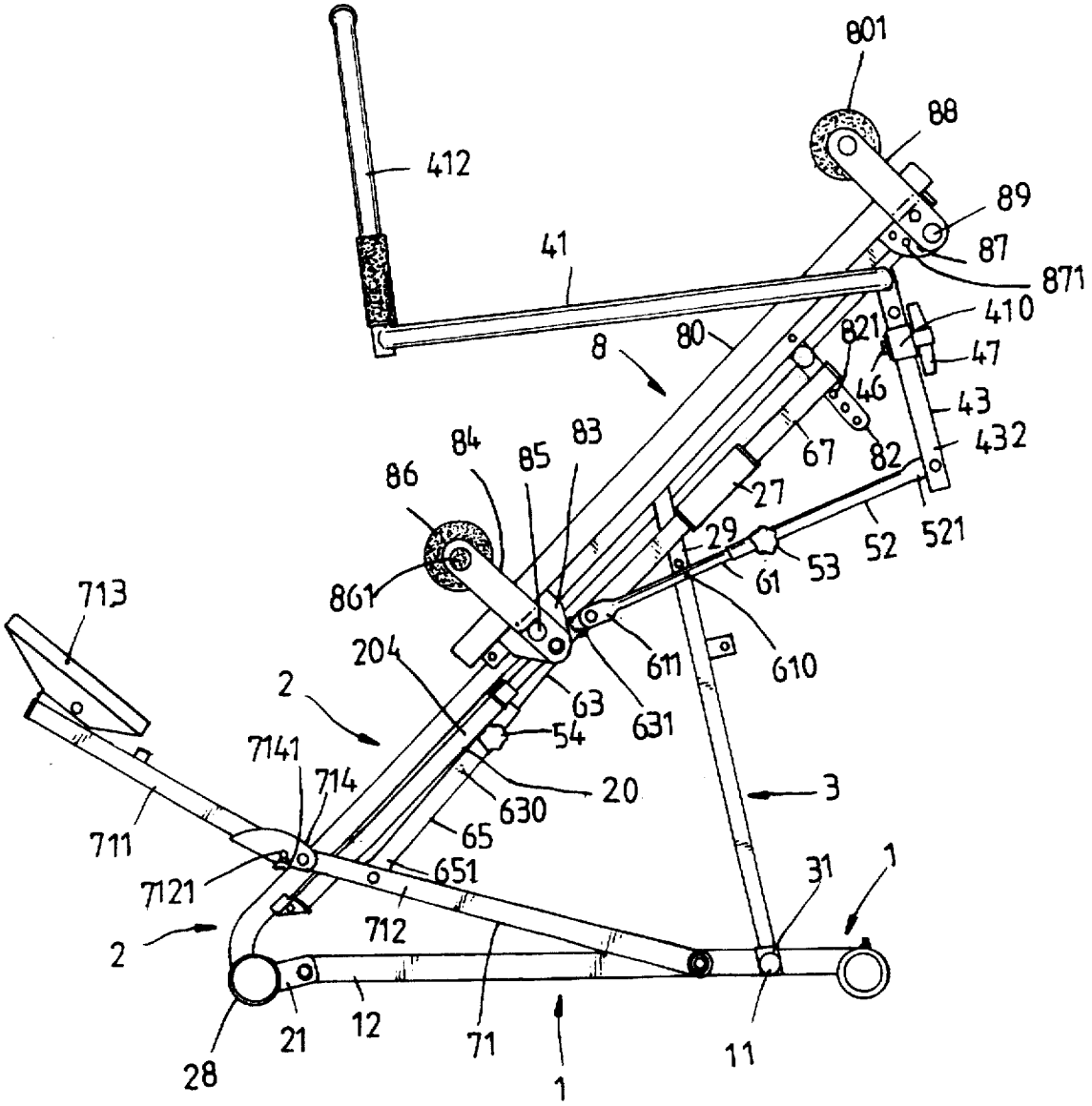
FIG. 3 is a side view of the fitness equipment according to the present invention.
Figure 6:
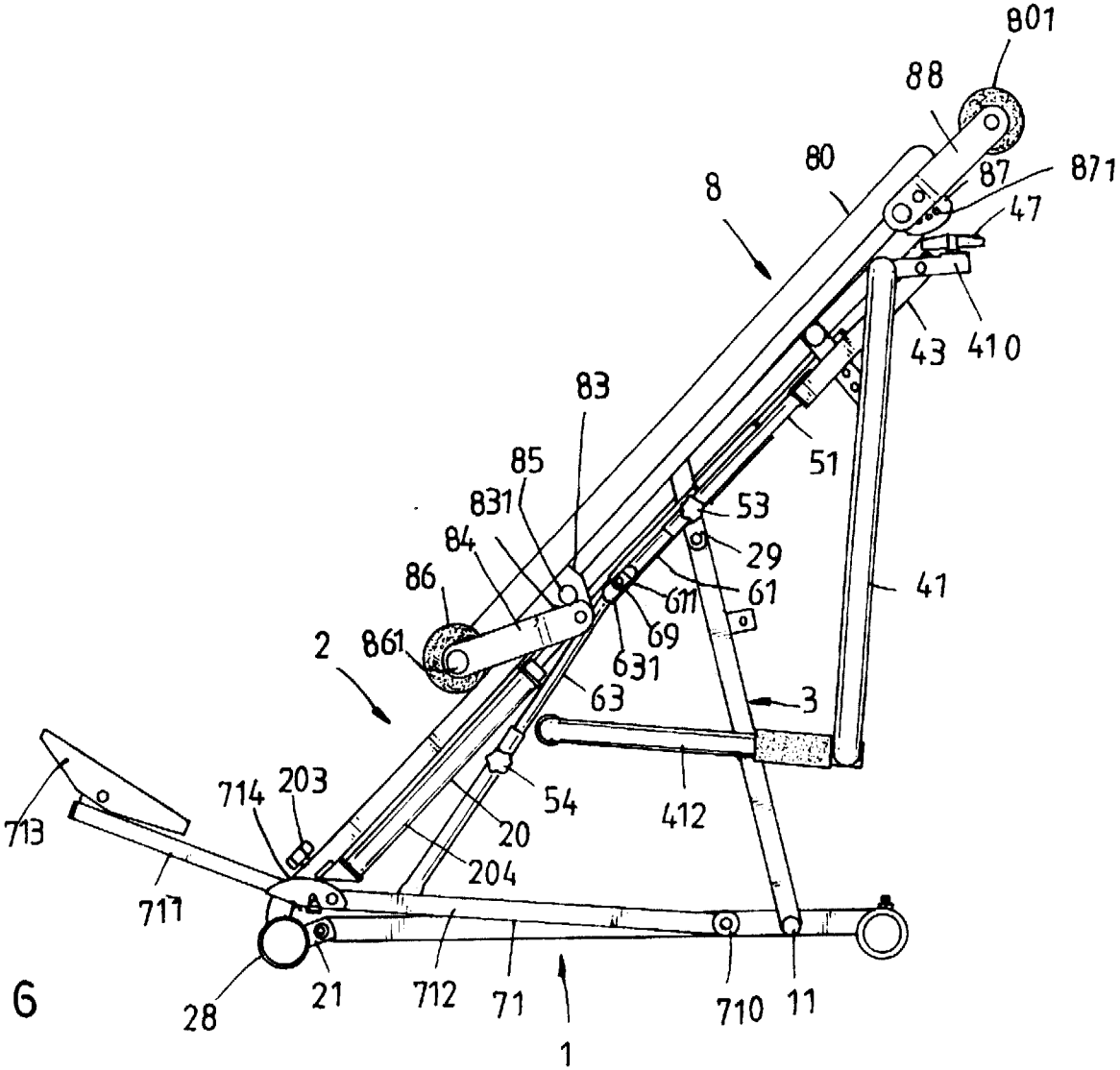
FIG. 6 is another side view of the present invention, showing the handlebars collapsed.
Figure 8:
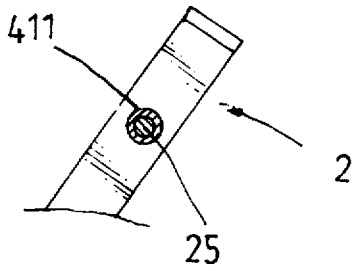
FIG. 8 is a sectional view of a part of the present invention, showing the connection between the rear end of the left handlebar and the respective axle of the oblique support.
Figure 9:
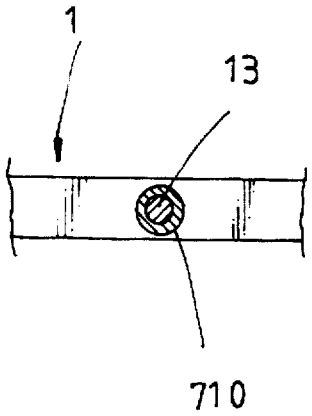
FIG. 9 is a sectional view of a part of the present invention, showing the connection between the rear end of the left pedal and one axle of the base.

Referring to FIGS. from 1 to 9, a fitness equipment in accordance with the present invention comprises: a base 1 having a rear end mounted with a pin to hold a bottom lug 31 of a bracing 3, a front end 12 coupled to a bottom end of an oblique support 2, and two pivots 13 bilaterally disposed near the rear end in front of the pin 11 to hold rear ends 710, 720 of left and right pedal 71, 72 (see FIG. 9);

an oblique support 2 having a bottom end equipped with a pair of wheels 28 for supporting on the ground, a pair of lugs 21 spaced between the wheels 28 and bilaterally pivoted to the front end 12 of the base 1, a bracket 22 disposed at the back side near the bottom to hold a damping mechanism 20, a transverse locating bar 23 spaced above the bracket 22 and pivoted to a bottom end of a bench 8, permitting two back locating plates 82 of the bench 8 to be fixed to an upper part of the oblique support 2 by a pin 24, two back lugs 29 bilaterally pivoted to a top end of the bracing 3, two axles 25 bilaterally disposed near the top and respectively pivoted to rear ends 411, 421 of left and right handlebars 41, 42 (see FIG. 8), permitting the rear ends 411, 421 of left and right handlebars 41, 42 to be fixed to the axles 25 by screws 26, a socket member 27 defining two parallel sliding holes 271 and adapted for holding left and right sliding bars 67, 68;

a bracing 3 having a bottom lug 31 pivoted to the pin 11 at the rear end of the base 1, and a top end 32 pivoted to the back lugs 29 of the oblique support 2;

a left handlebar 41 and a right handlebar 42 having a respective rear end 411, 421 respectivly fixed to the axles 25 of the oblique support 2 by screws 26, a respective front end terminating in a respective hand grip 412, 422, a respective backward frame 410, 420 perpendicularly and backwardly extended from the respective rear end 411, 421 and defining a respective sliding slot 4101, 4201;

two connecting frames 43; 44 respectively mounted on the backward frames 410, 420 of the handlebars 41, 42, having a respective front end terminating in a respective sliding slot 431, 441, respectively and adjustably fixed to the sliding slots 4101, 4201 of the backward frames 410, 420 by a respective screw 45 and a respective washer 46 and a respective wing nut 47, and a respective rear end 432, 442 respectively pivoted to top end 511, 521 of left and right actuating rods 51, 52;

left actuatiing rod 51 and a right actuating rod 52 having a respective top end 511, 521 respectively pivoted to the rear ends 432, 442 of the connecting frames 43, 44 and a respective tubular bottom end adapted for coupling to top ends of left and right upper links 61, 62;

a left upper link 61 and a right upper link 62 having a respective top end respectively inserted into the tubular bottom ends of the left and right actuating rods 51, 52, and adjustably fixed in place by a respective adjustment screws 53, a respective flat bottom end 611, 621 (see FIG. 3) respectively pivoted to bottom side blocks 671, 681 of left and right sliding bars 67, 68 and top ends of left and right intermediate links 63, 64;

a left sliding bar 67 and a right sliding bar 68 having a respective top end inserted through the sliding holes 271 of the socket member 27, and a respective bottom end with a respective side block 671, 681 respectively pivoted to top ends of left and right intermediate links 63, 64 and the bottom ends of the left and right upper links 61, 62;

a damping mechanism 20 which is comprised of a left hydraulic cylinder 204 and a right hydraulic cylinder 205 respectively pivoted to the bracket 22 of the oblique support 2, a left piston rod 201 and a right piston rod 202 having a respective bottom end respectively moved in the hydraulic cylinders 204, 205 and a respective top end pivoted to left and right intermediate links 63, 64;

a left intermediate link 63 and a right intermediate link 64 having a respective flat top end 631, 641 respectively pivoted to the bottom ends of the upper links 61, 62 and the bottom ends of the sliding bars 67, 68 by a respective pivot 69, a respective top barrel 60 respectively connected to the pivot 69 and connected to the top ends of the piston rods 201, 202 of the damping mechanism 20, and a respective bottom end inserted into tubular top ends of left and right bottom links 65, 66;

a left bottom link 65 and a right bottom link 66 having a respective tubular top end respectively sleeved onto the bottom ends of the left and right intermediate links 63, 64 and fixed in place by a respective adjustment screw 54, a respective flat bottom end 651, 661 respectively connected to top ends of left and right pedals 71, 72;

a bench 8 which is comprised of a bench body 80 having a bottom end 81 pivoted to the transverse locating bar 23 of the oblique support 2, a pair of back locating plates 82 raised from the back of the bench body 80 and having a respective row of locating holes 821 adjustably connected to the top end of the oblique support 2 by a pin 24, a pair of bottom lugs 83 raised from the bench body 80 near the bottom with a series of locating holes 831 spaced at different angles, a pair of top lugs 87 raised from the bench body 80 near the top with a respective series of locating holes 871 spaced at different angles (see FIG. 6), a pair of bottom arms 84 respectively fastened to the bottom lugs 83 by pins 85, a pair of top arms 88 respectively fastened to the top lugs 87 by pins 89, a cylindrical seat cushion 86 connected between the bottom arms 84 in front of the bench body 80, two handles 861 respectively raised from two opposite ends of the cylindrical seat cushion 86, and a headrest 801 connected between the top arms 88;

a left pedal 71 and a right pedal 72 having a respective rear end 710, 720 respectively turned about the pivots 13 of the base 1, and a respective front end respectively pivoted to the flat bottom ends 651, 661 of the left and right bottom links 65, 66.

Figure 4:
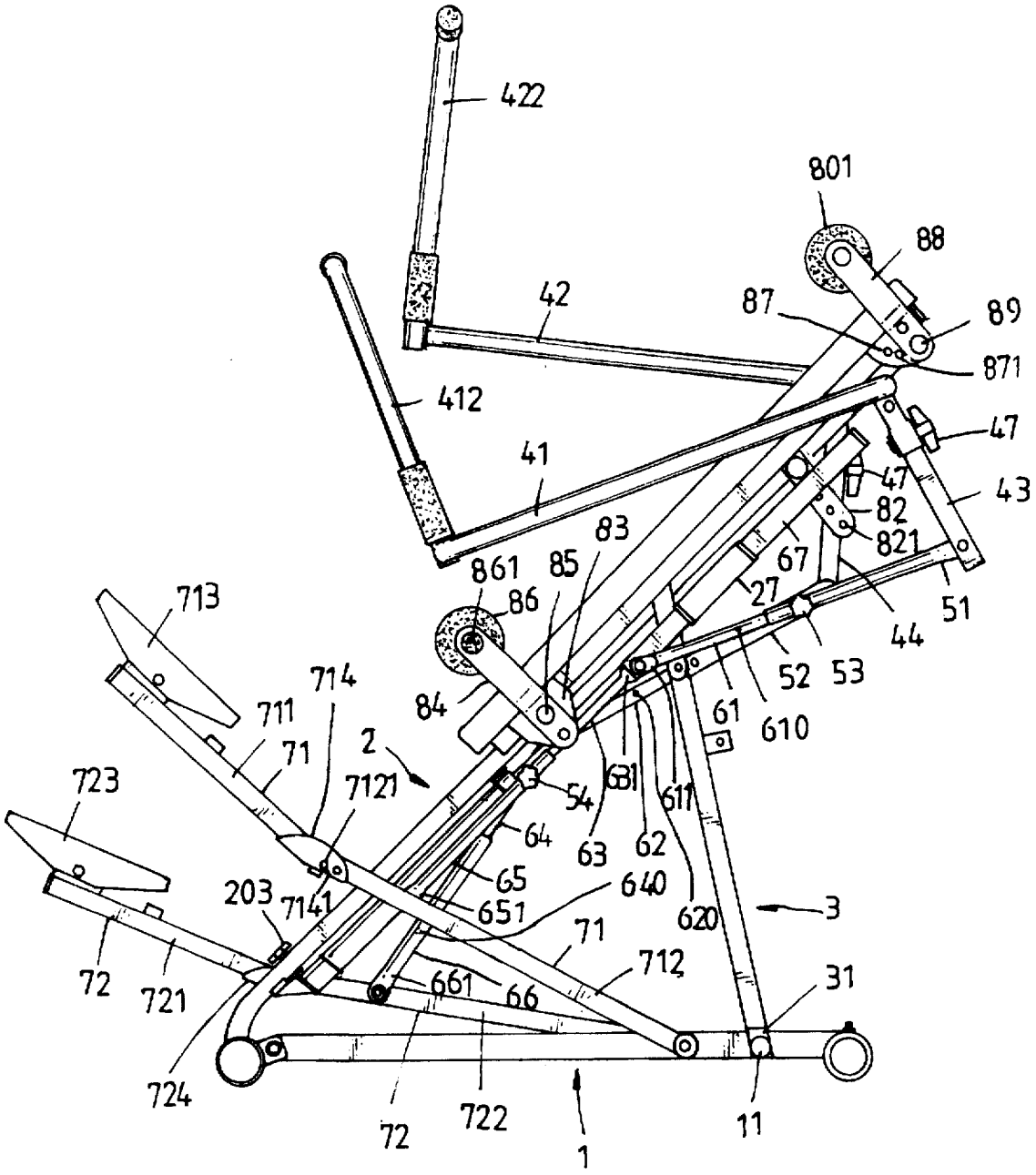
FIG. 4 is similar to FIG. 3 but showing the pedals pedaled and the handlebars turned.
Figure 5:
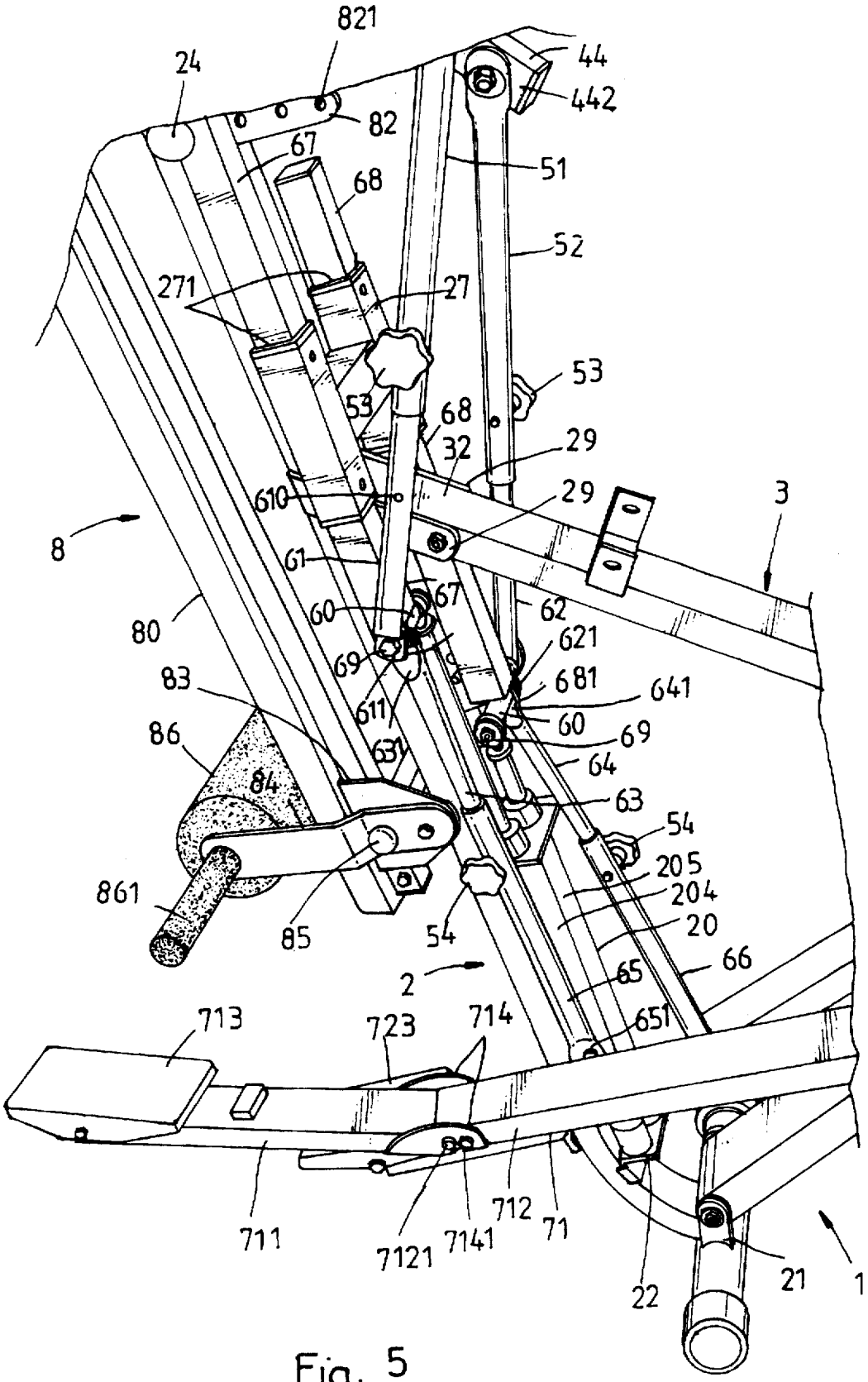
FIG. 5 is a partial view in an enlarged scale of the fitness equipment according to the present invention.

When in use, the user sits on the cylindrical seat cushion 86 with the back supported on the bench body 80 and the hands held on the hand grips 412, 422 of the handlebars 41, 42. When the user pedals the pedals 71, 72 with the legs, the bottom links 65, 66, the intermediate links 63, 64 and the upper links 61, 62 are alternatively driven to move the actuating rods 51, 52 and the connecting frames 43, 44 (see FIG. 4 and 5), to simulate the action of swimming, and at the same time the sliding bars 67, 68 are alternatively moved up and down in the sliding holes 271 of the socket member 27 to guide the movement of the moving parts of the fitness equipment smoothly. When operating, the piston rods 201, 202 of the damping mechanism 20 impart a damping resistance to the user.

The aforesaid pedals 71, 72 are respectively comprised of a front pedal plate 711, 721 and a rear pedal plate 712, 722. The front pedal plate 711, 721 comprises a foot plate 713, 723 at the front end, and a pair of lugs 714, 724 at the rear end pivoted to the front end of the rear pedal plate 712, 722. The lugs 714, 724 having locating notches 7141, 7241 at the bottom side. The rear pedal plate 712, 722 has locating rods 7121, 7221 at the front end respectively forced into engagement with the locating notches 7141, 7241 of the lugs 714, 724 to hold the frong pedal plate 711, 721 in the operative position. When the front pedal plates 711, 721 are respectively turned backwardly upwards, the locating rods 7121, 7221 are respectively disengaged from the locating notches 7141, 7241, and therefore the pedals 71, 72 are folded up into a collapsed condition.

Further, the bottom ends of the intermediate links 63, 64 have a respective locating hole 630, 640 (see dotted lines in FIGS. 3 and 4) at the respective bottom end. When the fitness equipment is collapsed, the locating holes 630, 640 of the intermediate links 63, 64 can be respectively fixed to the bottom links 65, 66 by the adjustment screws 54; the upper links 61, 62 have a respective locating hole 610, 620 at the respective bottom end. When the fitness equipment is collapsed, the locating holes 610, 620 can be respectively fixed to the actuating rods 51, 52 by the adjustment screws 53.

Figure 7:
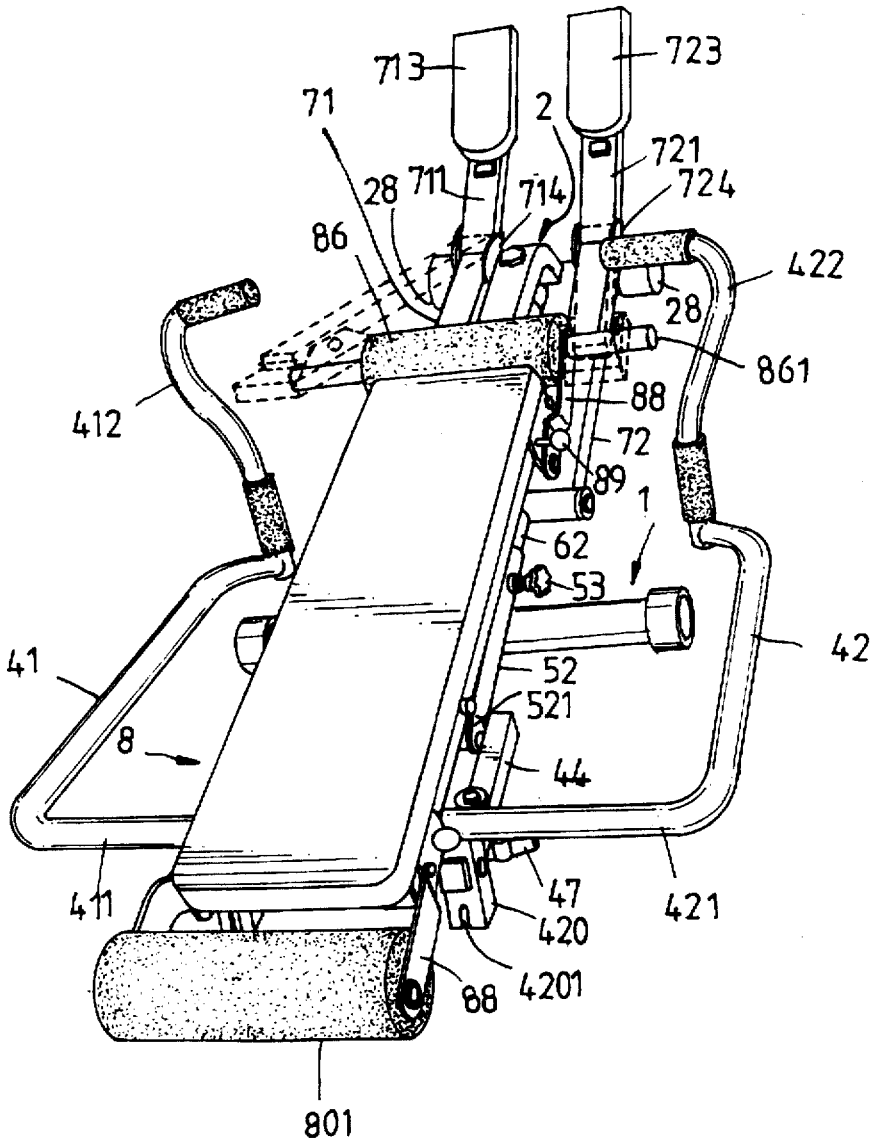
FIG. 7 is a collapsed view of the fitness equipment according to the present invention.
Figure 10:
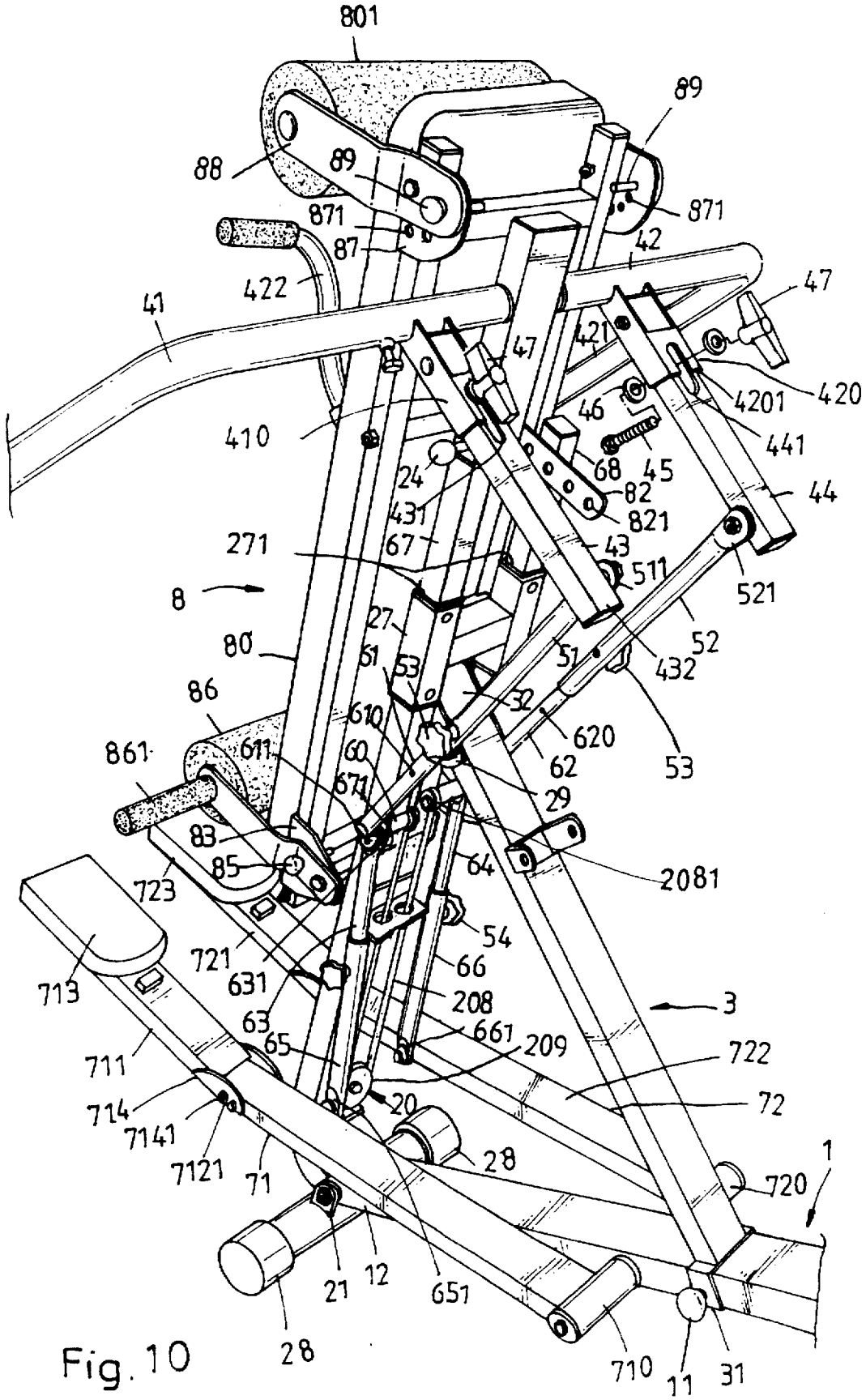
FIG. 10 is an elevational view of an alternate form of the present invention.

When the fitness equipment is not in use, the wing nuts 47 are loosened, permitting the connecting frames 43, 44 and the handlebars 41, 42 to be respectively turned downwards (see FIG. 6), then the adjustment screws 54 are loosened, permitting the pedals 71, 72 to be respectively turned to the base 1, and then the adjustment screws 53 are loosened, permitting the upper links 61, 62 and the actuating links 51, 52 to be respectively arranged into a line, and then the pin 11 is removed from the base 1, permitting the bracing 3 to be turned to the oblique support 2, and then the obliquue support 2 with the bench 8 are turned downwards and closely attached to the base 1, and then the front pedal plates 711, 721 are turned to the collapsed position and closely attached to the rear pedal plates 712, 722 (see FIG. 7). FIG. 10 shows an alternate form of the present invention, in which the damping mechanism 20 is comprised of a friction wheel 209 and a rope 208. The friction wheel 209 is mounted on the bottom end of the oblique support 2. The rope 208 is wound round the friction wheel 209, having two opposite ends 2081 respectively connected to the barrels 60 of the intermediate links 63, 64.

Figure 11:
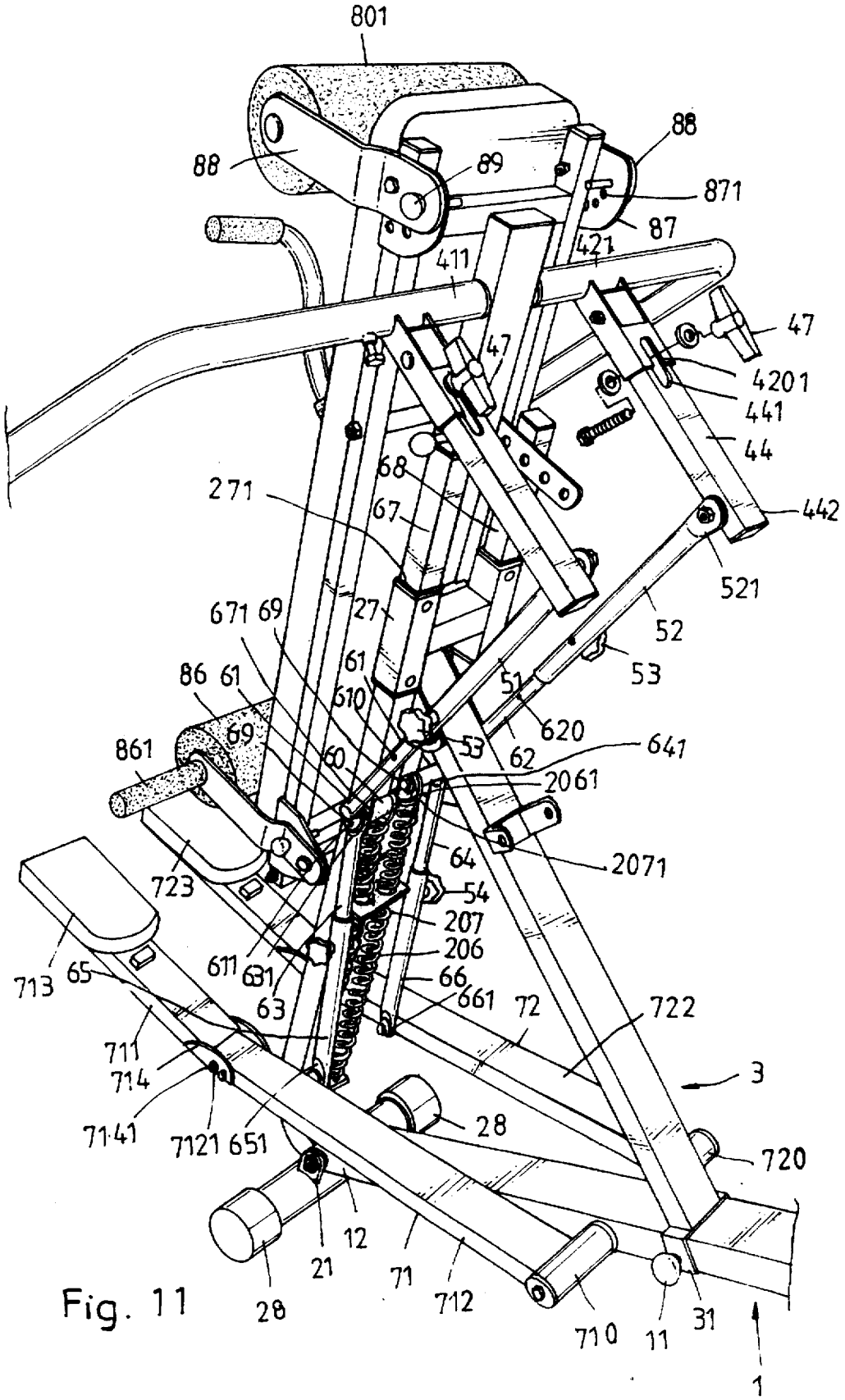
FIG. 11 is an elevational view of another alternate form of the present invention.

FIG. 11 shows another alternate form of the present invention, in which the damping mechanism 20 is comprised of two spring elements 206, 207 having a respective bottom end connected to the bracket 22 of the oblique support 2 and a respective top end 2061, 2071 respectively connected to the barrels 60 of the intermediate links 63, 64.

We claim:

1. A fitness equipment comprising:

a base having a rear end mounted with a pin, a front end and two pivots bilaterally disposed near the rear end;

an oblique support having a bottom end equipped with a pair of wheels for supporting on the ground, a pair of bottom lugs spaced between said wheels and bilaterally pivoted to the front end of said base, a bracket disposed at a back side, a transverse locating bar spaced above said bracket, two back lugs, two axles bilaterally disposed near a top end thereof and a socket member defining two parallel sliding holes;

a bracing having a bottom lug pivoted to the pin at the rear end of said base, and a top end pivoted to the back lugs of said oblique support;

two handlebars having a respective rear end respectively fixed to the axles of said oblique support by a respective screw, a respective front end terminating in a respective hand grip, a respective backward frame perpendicularly and backwardly extended from the respective rear end and defining a respective sliding slot;

two connecting frames respectively mounted on the backward frames of said left handlebar and right handlebar, having a respective front end terminating in a respective sliding slot respectively and adjustably fixed to the sliding slots of the backward frames of said handlebars by a respective screw and a respective washer and a respective wing nut, and a respective rear end;

two actuating rods each having a respective top end respectively pivoted to the rear ends of said connecting frames, and a respective tubular bottom end;

two upper links having a respective top end respectively inserted into the tubular bottom ends of said actuating rods and fixed in place by a respective adjustment screw, and a respective flat bottom end;

two sliding bars having a respective top end inserted through the sliding holes of the socket member of said oblique support and a respective bottom end with a respective side block respectively pivoted to the top ends of said upper links;

two intermediate links having a respective flat top end respectively pivoted to the bottom ends of said upper links and the bottom ends of said sliding bars, a respective barrel mounted on the respective pivot, and a respective bottom end;

a damping mechanism coupled between the bracket of said oblique support and the barrel of said intermediate links to impart a damping resistance;

two bottom links having a respective tubular top end respectively sleeved onto the bottom ends of said intermediate links and fixed in place by a respective adjustment screw and, a respective flat bottom end;

a bench mounted on said oblique support, said bench comprising a bench body having a bottom end pivoted to the transverse locating bar of said oblique support, a pair of back locating plates raised from a back side of said bench body and detachably connected to the top end of said oblique support by a pin, a pair of bottom lugs and a pair of top lugs respectively raised from said bench body at different elevations, said bottom lugs and said top lugs having a respective series of locating holes spaced at different angles, a pair of bottom arms respectively fastened to the locating holes of the bottom lugs of said bench by a respective pin, a pair of top arms respectively fastened to the locating holes of the top lugs of said bench by a respective pin, a cylindrical seat cushion connected between said bottom arms in front of said bench body, two handles respectively raised from two opposite ends of said cylindrical seat cushion, and a headrest connected between said top arms; and two pedals each having a respective rear end respectively turned about the pivots of said base, and a respective front end respectively pivoted to the flat bottom ends of said bottom links;

whereby when a user sits on said cylindrical seat cushion with the back supported on said bench body and the hands holding on the hand grips of said handlebars and the legs pedaling said pedals, said bottom links and said intermediate links and said upper links are alternatively driven to move said actuating rods and said connecting frames, enabling the user to simulate the action of swimming and at the same time said sliding bars are alternatively moved up and down in the sliding holes of said socket member to guide the movement of said bottom links and said intermediate links and said upper links and said actuating rods.

2. The fitness equipment of claim 1 wherein said pedals are respectively comprised of a front pedal plate, and a rear pedal plate having, said front pedal plate a front end terminating in a foot plate and a rear end terminating in a pair of lugs and bilaterally pivoted to said rear pedal plate, the lugs of said front pedal plate having a respective bottom locating notch, said rear pedal plate having a pair of locating rods bilaterally disposed at a front end thereof and respectively forced into engagement with the bottom locating notches of the lugs of said front pedal plate to hold said front pedal plate in the operative position.

3. The fitness equipment of claim 1 wherein the back locating plates of said bench have a respective row of locating holes adjustably connected to the top end of said oblique support by a pin.

4. The fitness equipment of claim 1 wherein the bottom lugs of said bench have a respective row of locating holes adapted for holding said bottom arms at one of a series of angular positions by a pin.

5. The fitness equipment of claim 1 wherein the top lugs of said bench have a respective row of locating holes adapted for holding said top arms at one of a series of angular positions by a pin.

6. The fitness equipment of claim 1 wherein the bottom ends of said intermediate links have a respective locating hole adapted for fixing to said bottom links by using the adjustment screw of said bottom links when the fitness equipment is collapsed.

7. The fitness equipment of claim 1 wherein the bottom ends of said upper links have a respective locating hole adapted for fixing to said actuating rods by using the adjustment screws of said upper links when the fitness equipment is collapsed.

8. The fitness equipment of claim 1 wherein said damping mechanism is comprised of a pair of hydraulic cylinders respectively pivoted to the bracket of said oblique support, two piston rods having a respective bottom end respectively moved in said hydraulic cylinders and a respective top end pivoted to the barrels of said intermediate links.

9. The fitness equipment of claim 1 wherein said damping mechanism is comprised of a friction wheel mounted on the bottom end of said oblique support, and a rope wound round said friction wheel and having two opposite ends respectively connected to the barrels of said intermediate links.

10. The fitness equipment of claim 1 wherein said damping mechanism is comprised of two spring elements having a respective bottom end connected to the bracket of said oblique support and a respective top end respectively connected to the barrels of said intermediate links.

* * * * *